US008291624B2

(12) United States Patent
Hall

(10) Patent No.: US 8,291,624 B2
(45) Date of Patent: Oct. 23, 2012

(54) BLADE ASSEMBLY FOR AN EXCAVATING APPARATUS

(75) Inventor: David John Hall, Toowoomba (AU)

(73) Assignee: Agrator Pty Ltd as trustee for Gessner Unit Trust, Toowoomba (AU)

( * ) Notice: Subject to any disclaimer, the term of this patent is extended or adjusted under 35 U.S.C. 154(b) by 116 days.

(21) Appl. No.: 12/439,957

(22) PCT Filed: Sep. 4, 2007

(86) PCT No.: PCT/AU2007/001297

§ 371 (c)(1),
(2), (4) Date: Sep. 2, 2009

(87) PCT Pub. No.: WO2008/028225

PCT Pub. Date: Mar. 13, 2008

(65) Prior Publication Data

US 2010/0031538 A1 Feb. 11, 2010

(30) Foreign Application Priority Data

Sep. 4, 2006 (AU) ..... 2006904874

(51) Int. Cl.
*E01H 5/06* (2006.01)

(52) U.S. Cl. ..... 37/266; 37/444; 172/811; 172/701.1

(58) Field of Classification Search ..... 37/266, 37/444, 272, 466, 274, 275, 273, 220, 403, 37/407, 409, 903; 172/811, 701.1, 815, 824, 172/825, 826, 701.3, 784
See application file for complete search history.

(56) References Cited

U.S. PATENT DOCUMENTS

| | | | | | |
|---|---|---|---|---|---|
| 2,590,352 | A | * | 3/1952 | Sanner et al. | 37/347 |
| 3,238,648 | A | * | 3/1966 | Cobb et al. | 172/664 |
| 4,991,662 | A | | 2/1991 | Caron et al. | |
| 5,392,864 | A | | 2/1995 | Lindenmuth | |
| 5,599,135 | A | * | 2/1997 | Delaurenti | 404/101 |
| D477,610 | S | * | 7/2003 | Matsumoto et al. | D15/11 |
| D478,098 | S | * | 8/2003 | Matsumoto et al. | D15/11 |
| 6,938,701 | B2 | | 9/2005 | Matsumoto et al. | |
| D534,929 | S | * | 1/2007 | Matsumoto et al. | D15/32 |
| D538,307 | S | * | 3/2007 | Matsumoto et al. | D15/32 |
| 7,191,846 | B2 | * | 3/2007 | Matsumoto et al. | 172/811 |
| 7,401,658 | B2 | * | 7/2008 | Matsumoto et al. | 172/811 |
| 7,654,336 | B2 | * | 2/2010 | Matsumoto et al. | 172/811 |
| 7,690,441 | B2 | * | 4/2010 | Matsumoto et al. | 172/811 |

FOREIGN PATENT DOCUMENTS

DE 155628 A 6/1982

* cited by examiner

*Primary Examiner* — Jamie L McGowan
(74) *Attorney, Agent, or Firm* — Austin Rapp & Hardman

(57) ABSTRACT

An alternative blade assembly for an excavating apparatus comprising a front face, side walls, a centre forward edge portion, side forward edge portions on either side of the centre forward edge and end forward edges at each distal side of the side forward edges, wherein the end forward edges have bottom edges which are lower than the bottom edge of the centre forward edge.

24 Claims, 11 Drawing Sheets

BLADE ASSEMBLY FOR AN EXCAVATING APPARATUS

PRIORITY CLAIM

This application is the National Stage of and claims priority to International Application No. PCT/AU2007/001297, filed Sep. 4, 2007, which designates the U.S., and claims priority to Australian Application No. 2006904874, filed on Sep. 4, 2006. The above-cited applications are expressly incorporated herein by this reference.

FIELD OF THE INVENTION

The present invention relates to a blade to be mounted on a variety of different work machines which for convenience will be referred to as excavating machines. These include bulldozers, tractor shovels, graders, drag line apparatuses, compacting machines etc. In the context of the invention a blade is intended to cover any type of working tool with an edge which is intended to contact material so that it can be moved. Thus a blade includes a bucket, collector, spreader etc.

For convenience the present invention will be described in relation to a bulldozer blade.

BACKGROUND OF THE INVENTION

A bulldozer can be used on a variety of working sites. The blade can be used for a variety of different operations including digging, carrying of soil or other material, banking, compacting and levelling. The design of the blade and how it is used determine the efficiency of the bulldozer in a working situation. It is therefore important to maximise working efficiency by designing a blade which is easier to use and can perform at least one function better than an existing blade.

The ability of a blade to dig into the ground depends on the shape of the front edge, force for pressing the blade into the ground as well as the angle of the blade when it contacts the earth. U.S. Pat. No. 6,938,701 discloses one type of bulldozer blade in which the front edge of the blade has a width which is larger than the width between the tracks of the bulldozer which carries it. This front edge is straight and perpendicular to the direction of movement of the vehicle in a forward direction. On either side of the central section the blade is angled rearwardly and then forwardly to provide three separate sections of cutting edges. The side and end sections are connected in a V-type configuration which is completely behind the front edge of the central section.

In operation the blade must be tilted downwardly with respect to its non-operative position in order to engage a ground surface.

The blade described in this patent suffers a number of drawbacks which reduce overall operating efficiency. One of the disadvantages with the blade design is that the blade must be tilted upwardly in order retain material effectively on its surface. Furthermore, the blade must be tilted downwardly to engage a ground surface. Furthermore, the ability of the blade to cut through a ground surface is inferior to blades which have a point. On top of this material which is contacted by the front edge moves up the front face of the blade but interferes with excavation of further material in front of the blade. Any material which moves to the side of the front edge of the blade generally escapes beyond each edge of the blade if the blade moves too far forward without being tilted upwardly.

Other disadvantages arise from the shape of the front face and difficulties associated with effectively cutting into a ground surface.

For existing bulldozers, present practices when loading material onto a blade that is tight is to use the corner tips to achieve penetration and roll the blade back once loaded. This has a tendency to turn the dozer towards the corner tip as the load is now off centre. If the operator is not very experienced he will use the steering clutches in an attempt to keep the dozer moving straight. It has also been noticed that existing blades do not fill to full capacity when in operation.

SUMMARY OF THE INVENTION

In accordance with the present invention it is preferred that a blade assembly is provided which is anticipated to result in much shorter loading length and higher fill capacities resulting in quicker cycle times with increased production as well as reducing fuel consumption when loading the blade.

Preferably the present invention provides a blade that can use its centre for penetration assisting the bulldozer's ability to use both tracks to push the blade and reduce the loading time then roll back once loaded.

Preferably a blade in accordance with the present invention has a centre for penetration which results in power being applied to the centre of the blade when loading and not the corners. It is expected that this will reduce maintenance costs as a result of less time being spent using the dozer's steering clutches and brakes when loading the blade.

It is preferred that a blade and/or blade assembly in accordance with the present invention can achieve one of the following objectives:

i. achieve a higher percentage of full blade pushes and reduce fuel costs;

ii. reduce cycle times and wear through centralising blade penetration pressures, a full blade on roll back and carry cycle and the utilisation of power through both tracks; and iii. increase payload filling reliability and reduce costs of bulldozing operations in cross pit, rehabilitation and bulk earthworks.

The present invention according to one aspect provides an alternative blade for an excavating apparatus comprising a front face, side walls, a centre forward edge portion, side forward edge portions on either side of the centre forward edge and end forward edges at each distal side of the side forward edges:

wherein the end forward edges have bottom edges which are lower than the bottom edge of the centre forward edge.

Preferably the end forward edge bottom edges are lower than the bottom edges of the side forward edges.

The bottom corners of distal edges of the end forward edge are preferably the lowest point of the blade.

It is preferred that the angle $\beta$ is less than $\theta$ where $\beta$ is the angle between the end forward edge and a line perpendicular to the centre forward edge and $\theta$ is the angle between the side forward edge and a line perpendicular to the centre forward edge.

The centre forward edge preferably extends perpendicular to the forward direction of the blade.

Preferably the side forward edges are each angled rearwardly with respect to the centre forward edge.

At least one of the forward edge portions is attachable to the front face.

At least one of the forward edge portions is removably attachable to the front face or other part of the blade.

At least one forward edge is made separately from the rest of the blade.

The side edges may extend forward from either side of the front face.

According to one embodiment the side edges extend outwardly from either side of the front face.

Each forward edge may comprise a metal plate or plate of other impact resistant material.

Preferably the blade is described on the basis it is resting on a ground surface or in a neutral position.

According to one embodiment the end forward edge has a forward most end edge which is behind the centre front edge.

According to another aspect of the present invention there is provided a blade for an excavating apparatus comprising a front face, side walls on each side of the front face, a centre forward edge portion, a side forward edge portion at each side of the centre forward edge portion and an end forward edge portion at each distal side of the side forward edge portion; wherein each side wall has a front edge which is behind the forward most edge of the end forward edges and in front of the rearmost portion of the side forward edge portions.

Each side wall may have a lower edge portion which is slanted rearwardly.

The lower front edge of the side walls may be in front of the rearmost portion of the end forward edges.

Each upper portion of each side wall preferably extends over the end forward edges.

Each end forward edge may be disposed inwardly of an outer portion of each end forward edge.

It is preferred that each side wall has a front edge which is located behind the centre forward edge portion.

Preferably the rearmost point of the side forward edge portions is located behind the front edge of the side walls.

According to one embodiment the corner portion located between the end forward edges and the side forward edges is located behind the front edge of the side walls.

According to one embodiment the centre forward edge portion comprises a lower edge which extends rearwardly below the front face in a generally horizontal orientation.

According to another aspect of the present invention there is provided a blade for an excavating apparatus comprising a front face, side walls on each side of the front face, a centre forward edge portion on each side of the centre forward edge portion and an end forward edge portion on each distal side of the side forward edge portion;

wherein the front face comprises a substantially concave centre section and side gusset portion on each side thereof for directing material outwardly toward the side walls.

Preferably each gusset portion comprises a curved plate section curved towards respective side walls.

Each gusset portion may comprise a generally triangular surface portion.

Each centre section preferably has substantially the same width as the centre forward edge portion.

The centre section may be aligned behind the centre forward edge portion.

Each gusset portion may extend at a slant forwardly to an outer mid section of the side forward edge.

Preferably the front face is contoured so that material slides off it when the blade is oriented in a neutral position (tilted neither up or down).

Alternatively or in conjunction the front face is contoured so that the material slides off it when the side walls top edge is parallel to the ground.

According to one embodiment the width of the centre forward edge portion is less than the width between tracks of a vehicle or wheels of a vehicle to which the blade is connected/attached.

The blade may be adapted to be tilted forward and back/down and up.

Preferably the width W of the centre forward section is less than the width of the side forward edge portions M.

The width of the end forward edge portions is preferably less than the width of the side forward edge portions.

Preferably the width of the end forward edge portions is less than the width of the centre forward edge portion.

According to one embodiment of the invention the side walls are straight/vertical in a neutral position of the blade.

Preferably each optional feature of the invention can be used in any aspect of the invention.

Each edge may be inclined forward between 70° and 30° when the blade is in a neutral position.

Preferably the side forward edge is at an obtuse angle with respect to the centre forward edge.

According to one embodiment the blade is attached to a controlling machine through a lower pivot and an upper pivot connected to an actuable piston, which is adapted to tilt the blade upwardly or downwardly with respect to the lower pivot.

According to another aspect of the present invention each of the forward edge portions may be made separately as removably attachable plates.

It is preferred that the end forward edges have pointed lower end edges, which are configured to engage a ground surface before any part of the centre forward edge portion.

It is preferred that the front face comprises a concave surface from a lower end portion to an upper end portion.

Preferably the whole of the front face is concave.

According to one embodiment the front face comprises two concave portions, the lower concave portion being configured to allow retention of material thereon if the blade is tilted upwardly from its neutral position.

According to one aspect of the present invention anyone of the blades hereinbefore described is part of a blade assembly including attachment portions to enable the blade to be attached to an excavation apparatus such as a bulldozer, backhoe, or any other vehicle which utilises an excavation bucket.

It is to be understood that reference to "blade" is to be interpreted broadly to cover an excavation bucket, a digging implement which collects material and any other device which engages a ground surface or material deposited on a ground surface or equivalent and is able to cut or dig through the material and collect it on its upper surface.

According to another embodiment of the present invention there is provided a blade assembly comprising a blade according to any one of the above defined embodiments.

It is preferred that a blade assembly in accordance with one of the above defined embodiments includes one or more attachment portions for attachment to controlling rams for tilting the blade.

According to another embodiment of the present invention a blade according to any one of the previously described embodiments includes an attachment portion for attachment to a lifting ram.

According to a further embodiment of the present invention there is provided a blade assembly including a blade according to any one of the previously defined embodiments and an attachment portion which is configured to be attached to a lifting arm of a vehicle such as a bulldozer.

According to another aspect of the present invention there is provided a method of controlling a blade according to any one aspect of the invention previously defined, the method comprising moving the blade downwardly, forcing the lowermost edge of the blade below a ground surface and tilting the blade upwardly while the lowermost edge is below the ground surface.

It is preferred that the lowermost edge comprises the centre forward edge portion.

Preferably the blade is tilted to a generally horizontal disposition.

It is preferred that the blade is tilted upwardly so front edges of the side walls are substantially in a vertical orientation.

According to another aspect of the present invention there is provided a controller for controlling operation of a blade assembly comprising a blade according to any one of the aspects of the invention previously defined, lifting pistons, tilting pistons and support arms, wherein the blade is able to be controlled by the pistons and support arms to engage a ground surface and roll back/tilt upwardly once the blade cuts into the ground surface.

According to a further aspect of the present invention there is provided a controller for controlling operation of a blade as defined in any one of the previous aspects of the present invention, the controller comprising a first module for controlling operation of tilting pistons, a second module for controlling lifting pistons and a third module for controlling blade support arms, wherein based on data relating to the material which is to be engaged by the blade, the first module is operated to control the lifting piston to drop the blade, the second module is operated to control the tilting piston to tilt the blade downwardly and wherein when the centre forward edge portion has cut into the ground surface/material module 2 is operated to control the tilting piston to tilt the blade upwardly while maintaining the lowermost edge of the centre forward edge portion below the ground surface/material surface.

It is preferred that the third module maintains the blade in a substantially constant position relative to the ground surface. In this respect it is to be understood that the supporting arms are preferred to be in a horizontal disposition when the blade is tilted downwardly and the centre forward edge portion engages the ground surface/material.

According to the preferred embodiment of the present invention the support arms are pivotally connected to a rearward back portion of the blade through an attachment portion.

It is to be understood that the blade in accordance with one or more embodiments of the invention is connected to a machine such as a bulldozer through linkages including rams/pistons and supporting arms in a configuration consistent with conventional bulldozers.

According to one embodiment each module comprises a sub program of a computer program.

According to one embodiment of the present invention the controller includes one or more sensors for sensing the orientation of the blade.

According to another embodiment of the present invention each linkage (piston, arm, etc. includes a sensor for sensing the position/length of extension or contraction of a linkage.

According to one embodiment of the invention the tilting piston comprises a cylinder and rod and a position sensor for sensing the relative position of the rod and the cylinder.

According to another embodiment the lifting piston comprises a cylinder, rod and sensor for sensing the relative position of the rod and cylinder.

According to another embodiment of the present invention the support arms comprise a sensor for sensing the orientation of the arms with respect to a horizontal and/or vertical axis.

According to a further aspect of the present invention there is provided a method of controlling a blade in accordance with the present invention as defined in any one of the previous aspects, comprising collecting material on a front face of the blade, lifting the blade upwardly by operating the lifting pistons, tilting the blade upwardly by operating the tilting pistons whereby lowermost edges of the blade disengage from a ground surface.

It is preferred that the method includes moving the blade forward once it has disengaged from a ground surface.

BRIEF DESCRIPTION OF THE DRAWINGS

A preferred embodiment of the present invention will now be described by way of example only with reference to the accompanying drawings in which.

DETAILED DESCRIPTION OF THE DRAWINGS

In accordance with a preferred embodiment of the present invention a blade will be described that can use its centre forward edge for penetration. In relation to a bulldozer application for which the preferred embodiment will be described, this will assist the dozer's ability to use both tracks to push the blade and reduce the loading time and then roll back once loaded.

It is considered that if more power can be utilised when loading the blade a much shorter loading length and higher fill capacities can be gained giving quicker cycle times within increased production as well as reducing fuel consumption when loading the blade.

Figure 1:
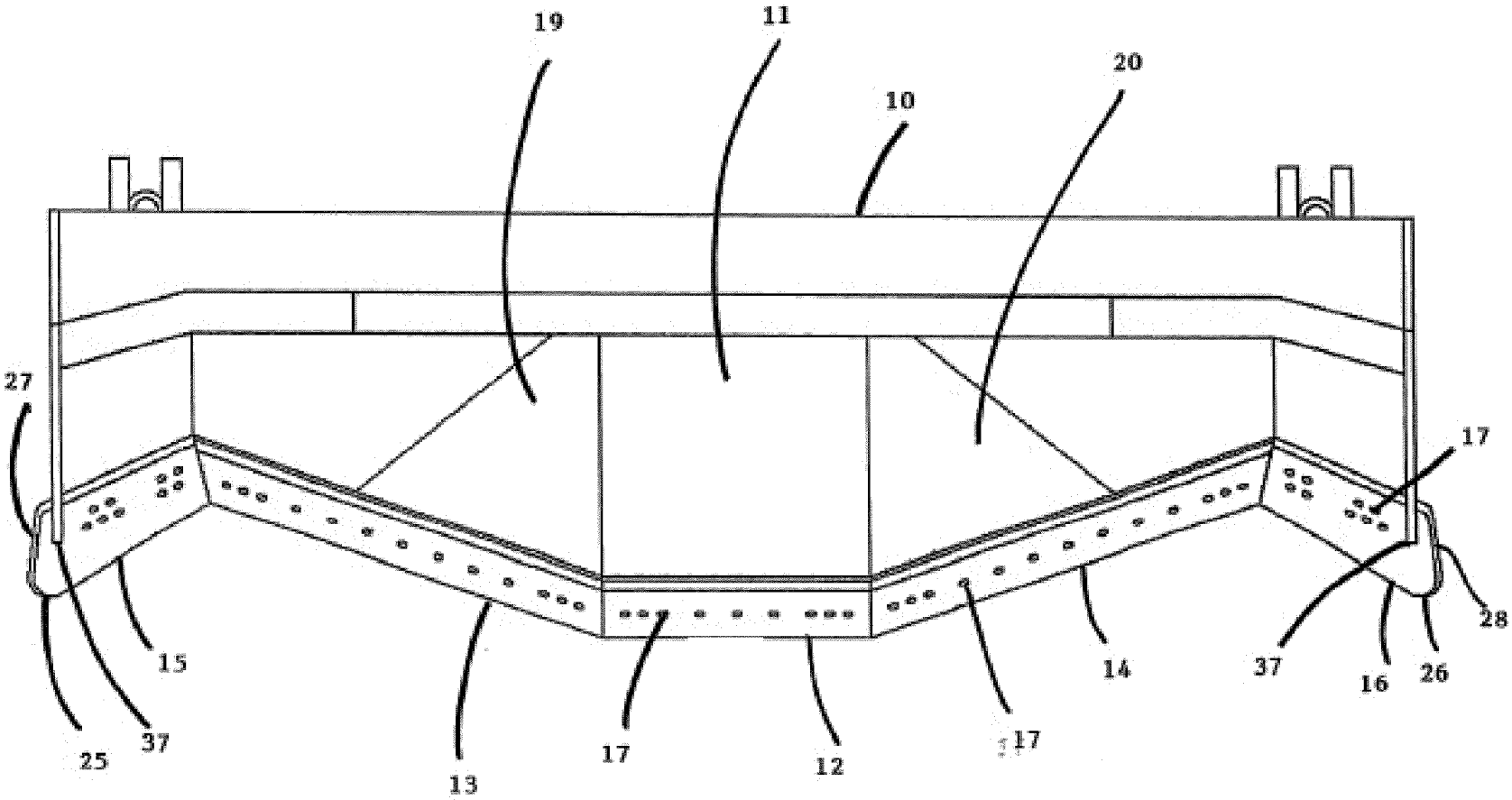
FIG. 1 shows a plan view of a blade according to a preferred embodiment of the present invention.
Figure 2:
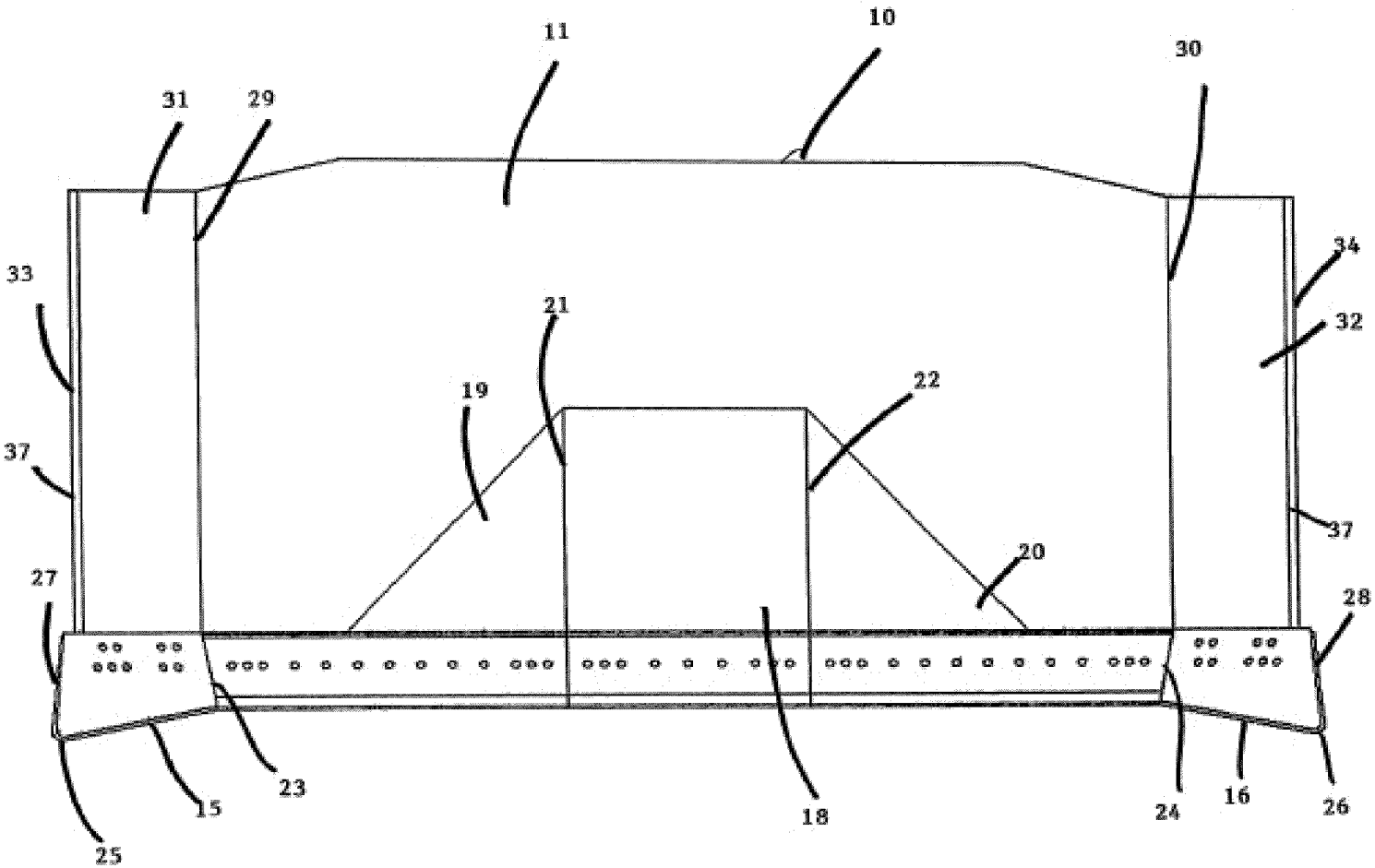
FIG. 2 shows a front view of the blade shown in FIG. 1.

As shown in FIGS. 1 and 2 a blade 10 in accordance with the preferred embodiment of the present invention consists of a front face 11 having a centre edge 12, middle edges 13 and 14 on either side of the centre edge 12 and end edges 15 and 16 on each end of the side edges 13, 14.

Each of the front edges 12, 13, 14, 15 and 16 are preferably separately made from the rest of the blade and are removably attachable thereto. Thus in FIGS. 1, 2 and 5 a series of holes 17 are shown representing attachment points.

Rearwardly of each edge 12, 13, 14, 15, 16 the front face is specially shaped to enhance cutting by the blade as well as distribution of cut material away from the centre of the blade and furthermore retention of material on the blade when it is tilted upwardly from its cutting position.

The centre edge 12 of the blade extends rearwardly in a generally concave arc which preferably constitutes a rolled section of constant width and of the same width as the centre edge 12. This rearward centre section 18 extends approximately half way along the front face as shown more clearly in FIG. 4. In FIG. 2 this central front section 18 appears rectangular.

It is preferred that section 18 is a separately formed metal plate which is formed on the front face 11.

Left and right side gussets 19, 20 curve to each side from the left and right side 21, 22 of the central front section 18. In FIG. 2 these gussets 19, 20 look triangular and extend forwardly from the rearmost end of the central front section 18 to middle blades 13 and 14 respectively to a point closer to their outer ends than their inner ends.

In effect both the central front section 18 and side gussets 19 and 20 appear as a raised section in the centre of the front face 11.

The centre edge 12 is essentially straight and perpendicular to the direction of movement of the blade in the forward direction. Each of the middle edges 13, 14 slant rearwardly at a angle of approximately 25° with respect to the centre edge 12. Each of the middle edges 13 and 14 are approximately twice as long as the centre edge 12 and at their outer ends 22, 23 form a V-shaped angle with the end edges 15 and 16 respectively.

The thickness of each of the front edges 12 to 16 is generally the same and each of them may be in the form of a metal plate.

The end edges 15 and 16 are angled forwardly and laterally from the middle edges 13 and 14. They form an angle of approximately 110° with respect to each of the middle edges 13, 14.

As shown in FIG. 1, each end edge 15, 16 has a lower front corner 25, 26 which is located behind the centre edge 12. It is also noted that the front edge 27, 28 of the end edges 15, 16 are slanted slightly forwardly to form a slightly pointed corner 25 and 26 respectively.

As shown in FIG. 2 the horizontal level of the centre edge 12 and middle edges 13 and 14 is approximately the same. However the end edges 15 and 16 are angled slightly downwardly and forwardly from the ends 23 and 24.

The front face 11 which is generally a concave shaped shovel has a general curvature on either side of the central front section 18 to each side 29, 30. These sides 29, 30 are represented as vertical crease lines which form corner sections with outer wall sections 31, 32 which extend laterally and forwardly at a similar angle to the end edges 15 and 16 with respect to the middle edges 13 and 14. Side plates 33 and 34 extend from these walls 31 and 32 generally in a forward direction and thus perpendicular to the centre edge 12.

The side walls 33, 34 are typically in the form of large metal plates extending from the top of the front face forwardly in a straight line then vertically downwardly to a slanted section 35 approximately three quarters of the length from the top corner edge 36 and inwardly to a point on the front face behind the end edges 15, 16.

As shown in FIG. 1 front end 37 of the side walls 33, 34 extend over part of the end edges 15 and 16 to a forward position approximately half way across them. The front edges 27 and 28 of the end edges 15 and 16 are the lateral most parts of the front face and extend beyond the side walls 33, 34 in a lateral direction. It is also noted that the corners 25 and 26 are both in front of and further to the side of the side walls 33, 34 than their front edges 37.

It is preferred that the overall concave curvature of the front face 11 with the raised central sections 18, 19 and 20 is such that when the blade is connected to the bulldozer and is in a neutral position, that is it is not tilted forward or backward, any material on the front face of the blade is able to slide off it. Furthermore, only a slight tilting upwardly of the blade results in retention of a significant amount of material on the front face of the blade.

Figure 3:
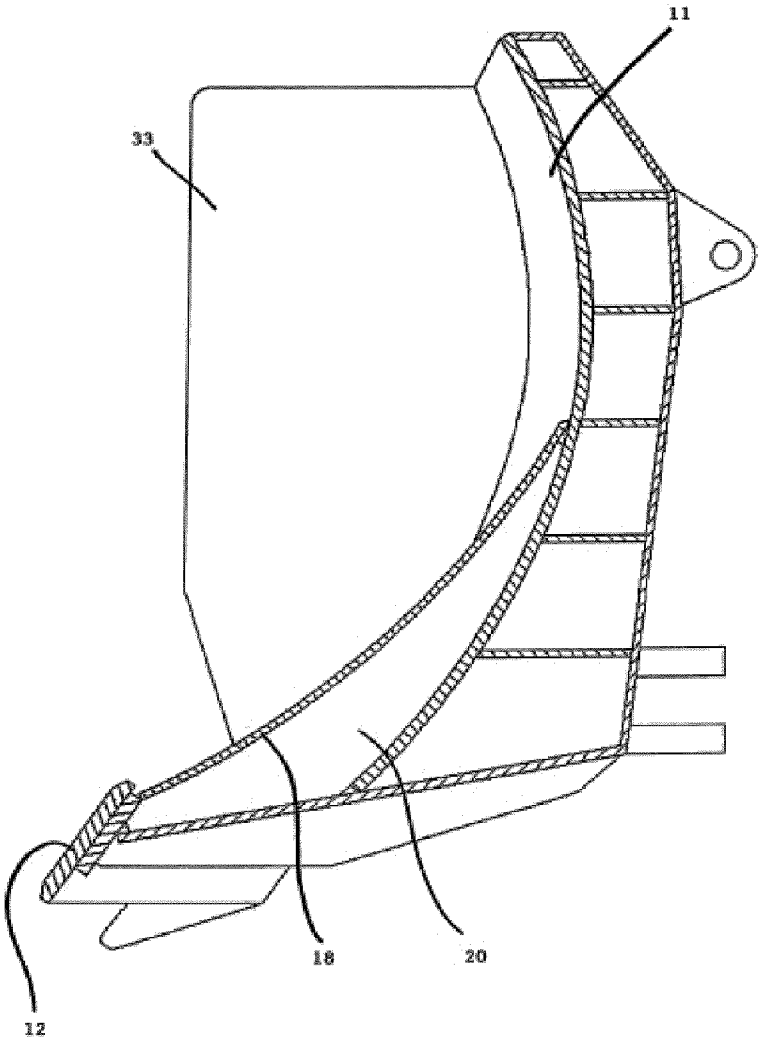
FIG. 3 shows a cross-sectional side view of the blade shown in FIG. 1.
Figure 4:
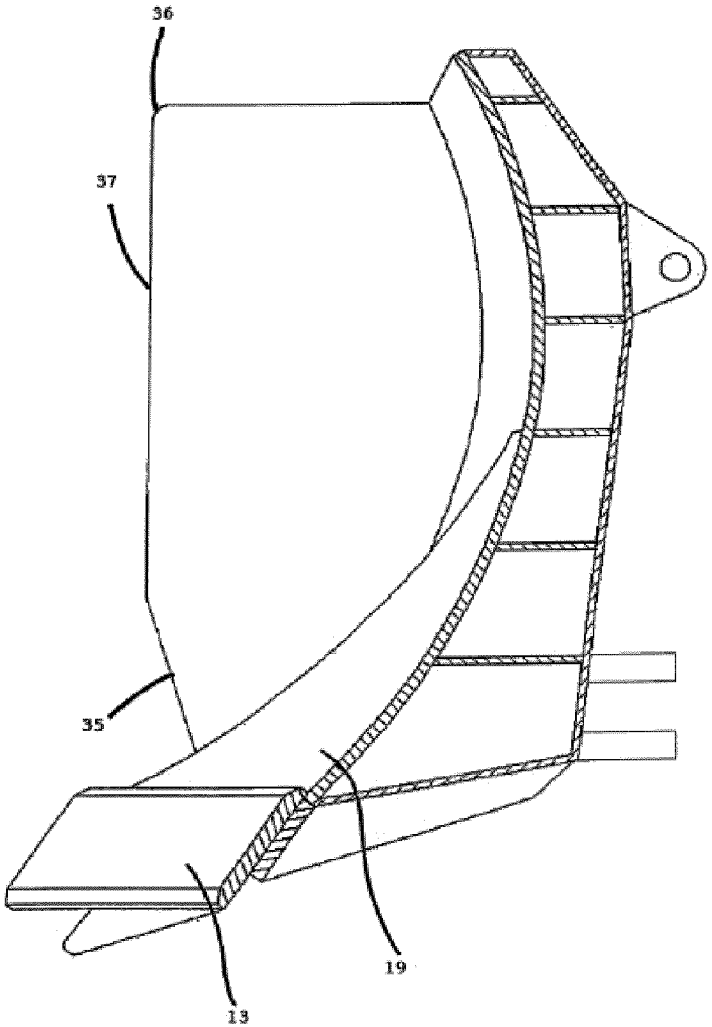
FIG. 4 shows another cross-sectional view of the blade shown in FIG. 1.
Figure 5:
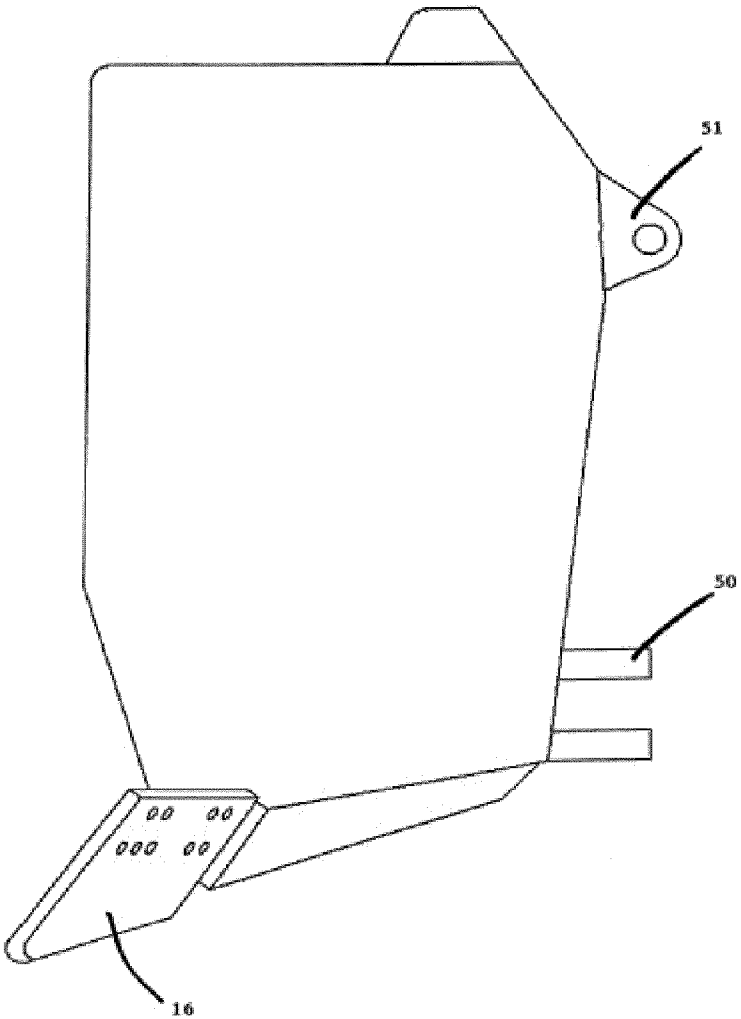
FIG. 5 shows a side view of the blade shown in FIG. 1 at cross section A.

As shown in FIGS. 3 and 4, the centre edge 12 and middle edges 13 and 14 are generally flat and straight. In FIG. 5 the rear face of the middle edge 14 is shown and this is also generally flat and straight and each of the edges appears as a thick metal plate.

Behind the blade 10 connection points 50 and 51 are provided at the lower end and close to the top end. The lower end is connected through a pivotal support part through connecting arms to a bulldozer and the point 51 is connected to a pivotal piston arm of the bulldozer. As a result tilting of the blade 10 occurs by movement of the piston and hence pivoting of the blade with respect to the connection point 50.

A blade having the features described above when connected to a bulldozer is able to be tilted slightly downwardly so that the centre edge 12 is able to engage a ground surface or material on a ground surface. Initially the corners 25 and 26 of the end edges 15 and 16 contact the ground because they are lower. This also has the result that they wear more quickly than the centre edge and provide a barrier to help capture material within the confines of the blade.

As the blade moves forwardly material moves up the centre edge 12 onto the central front section 18 and is distributed by side gussets 19 and 20 outwardly in a lateral direction. This directs material towards the side walls 33, 34. These walls act as a barrier which helps retain material within the confines of the blade. This retention is enhanced by the front edge 37 being located in front of the rearward edge of the end edges 15 and 16.

Because the material is directed outwardly to the sides of the blade, cutting/grading by the centre edge 12 is enhanced because material is moved away from the central region. This movement to the sides may be enhanced by increasing the size of each of the gussets 19 and 20 and reducing the width of the section 11. For example the section 11 may be made triangular with an apex at a rearward most point, thus having a triangular appearance with the apex of the triangle at a rearward point and the sides of the triangle leading into each of the gussets 19, 20.

Some of the noteworthy features of the preferred embodiment include the following:

i. the centre cutting edges forward of the corner tips;

ii. the centre cutting edge is at the same level as the corner tips when the blade is in the central or carry position;

iii. the corner tips are lower than the centre cutting edge when the blade is in the central or carry position;

iv. the centre cutting edge is lower than the corner tips when the blade is rotated forward or down into the digging position;

v. the centre cutting edge is higher than the corner tips when the blade is rotated back;

vi. the blade has larger side plates to carry more material; and vii. the side plates are forward of the back edge of the corner tip.

Figure 6:
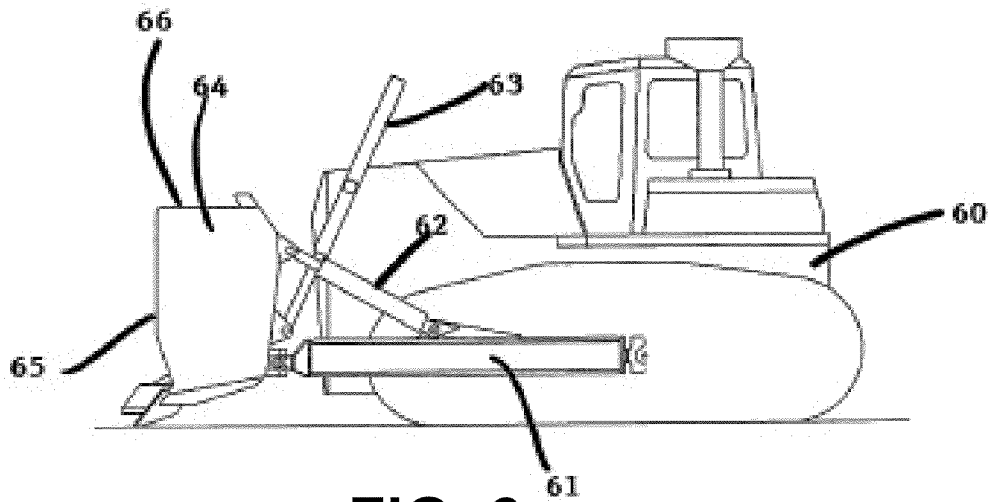
FIG. 6 shows a side view of a bulldozer with a blade in accordance with a preferred embodiment of the present invention in a neutral position.

In accordance with one embodiment of the present invention a blade in accordance with features of the preferred embodiment can be attached to a bulldozer as shown in FIG. 6.

When the blade is used on a dozer it provides the dozer with a number of operational features which are not available to dozers with existing blades.

Thus according to one embodiment larger dozers with the blade according to the present invention have a function that allows the on board processor of the dozer to pitch the blade forward to dump material from the blade when the blade is raised past a preselected position. This function can be expanded to control the pitch of the blade when a digging operation is undertaken.

In accordance with a preferred embodiment of the invention when the dozer is in the neutral position the cutting edges of the blades are all level with the ground except for the corner tips or outside cutting edges which may be lower. As shown in FIG. 6 the supporting arms 61 of dozer 60 are generally horizontal with tilting pistons 62 at approximately 45° with the control arms 61 and lifting pistons 63 also approximately at 45° with respect to the arms 61. In this position the blade 64 is able to push material to a dump site. As shown the side plates 65 generally have their front edges 65 vertical and their top edges 66 horizontal.

Figure 7:
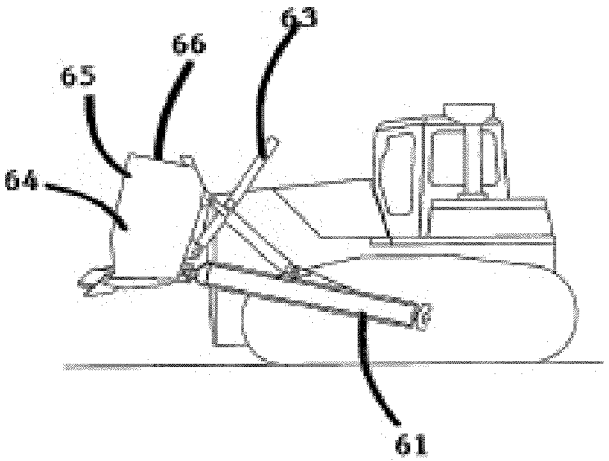
FIG. 7 shows the bulldozer shown in FIG. 6 with the blade raised.
Figure 8:
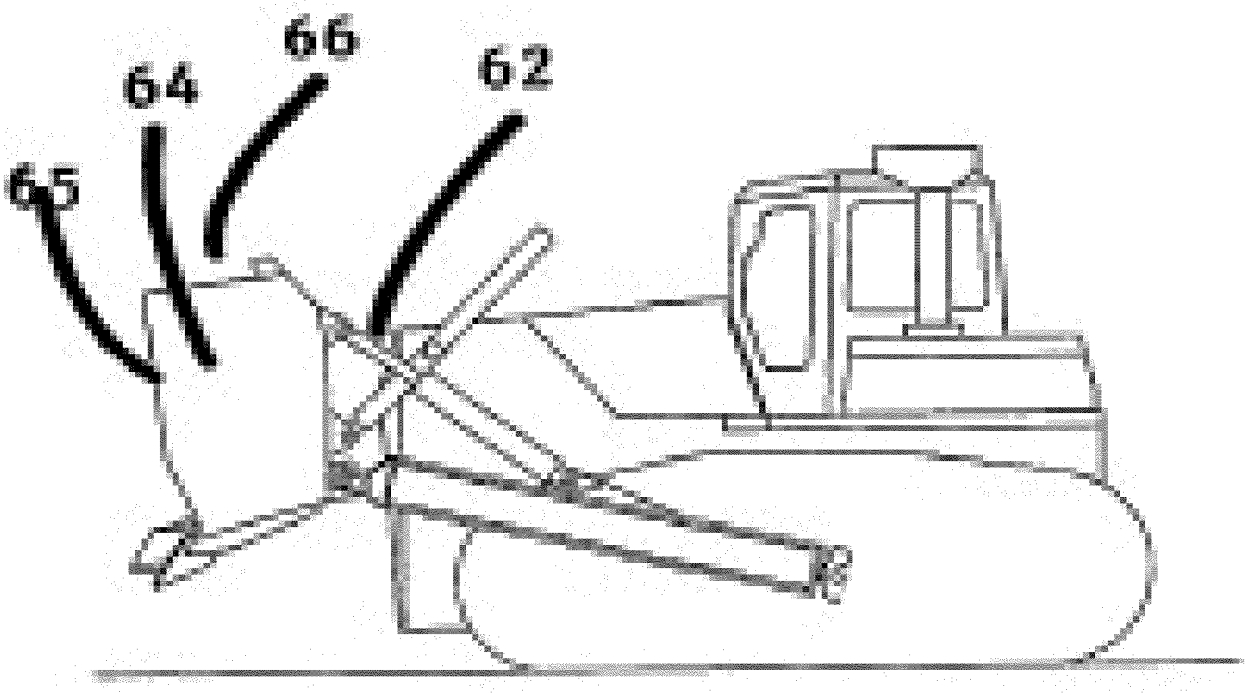
FIG. 8 shows the blade and bulldozer shown in FIG. 7 with the blade pitched forward.

Once the blade 64 is raised by pivoting the arm 61 upwardly using the lifting piston 63, as shown in FIG. 7, the onboard processor may be operated to pitch the blade 64 forward as shown in FIG. 8. This is achieved by operation of the tilting pistons 62.

As shown in FIGS. 7 and 8 when the blade 64 is raised, edges 65 and 66 effectively pivot clockwise whereas in FIG. 8 they pivot anticlockwise. The result is the edges 65 and 66 are no longer in the vertical and horizontal disposition shown in FIG. 6.

With the blade pitched forward, material collected on the blade is able to flow down from the blade and hence reduce any material from sticking to the blade and being carried back to the dig position.

It is preferred that the onboard processor is programmed for an autopitch step involving the raising and lowering of the blade as shown in FIGS. 7 and 8. Alternatively an operator can perform these steps manually.

It is preferred that this function is part of a normal digging cycle involving loading, dumping and clearing/dislodging material on the blade.

According to one embodiment it may be an advantage to set the dig or pitch forward auto operation in an aggressive setting for hard material. This would start the pitching of the blade when the blade is lowered a short distance from the neutral position. It may also be an advantage to set the auto pitch in a less aggressive setting when digging softer material. This less aggressive setting would allow the blade to be lowered a larger distance from the neutral position before the blade is pitched forward.

The dump auto settings may be set in the same manner outlined above.

Figure 9:
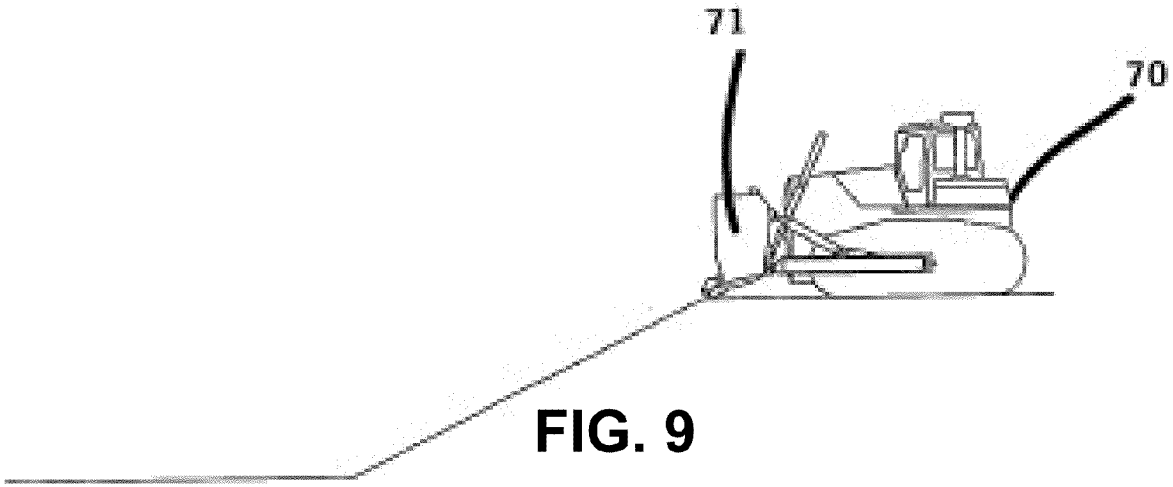
FIG. 9 shows a bulldozer and blade in accordance with one embodiment of the invention on a horizontal ground surface.
Figure 10:
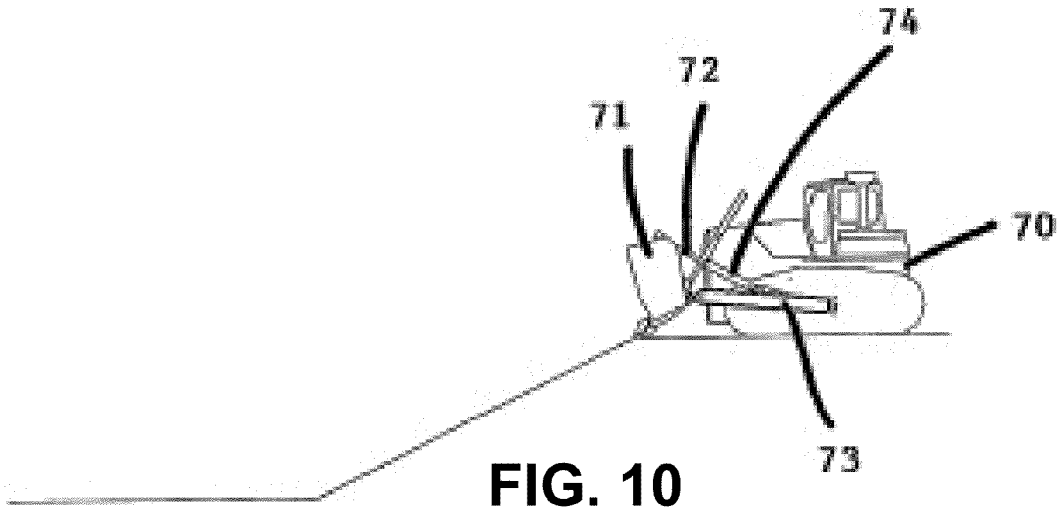
FIG. 10 shows the bulldozer and blade shown in FIG. 9 with the blade tilted downwardly.

In the operation described above a bulldozer is able to be used to push material to a dump site. According to another operational task a bulldozer may be required to operate on a downwardly or upwardly inclined slope. FIGS. 9, 10, 11, 12, 13, 14 and 15 show how a bulldozer with a bucket according to the preferred embodiment may be operated so as to control the orientation of the bucket as the bulldozer moves forward. Thus as shown in FIG. 9, the bulldozer 70 with a bucket 71 is operated so that the onboard processor uses the auto pitch feature to follow the contour of the ground surface. Thus in FIG. 10 the blade 71 is pitched/tilted forwardly using tilting pistons 72 after a slight lifting of the blade 71 by operation of arms 73 and lifting pistons 74.

Figure 11:
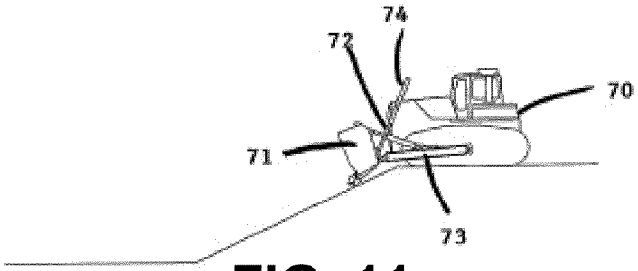
FIG. 11 shows the bulldozer and blade shown in FIG. 10 with the blade lowered below the horizontal ground surface.
Figure 12:
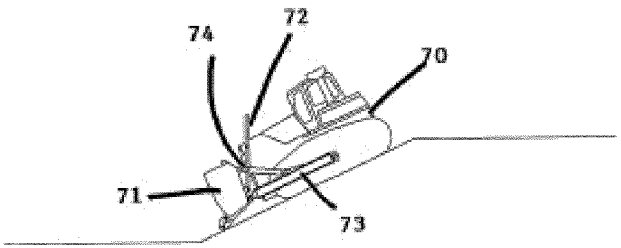
FIG. 12 shows the bulldozer and blade shown in FIG. 9 moving down an inclined surface.
Figure 13:
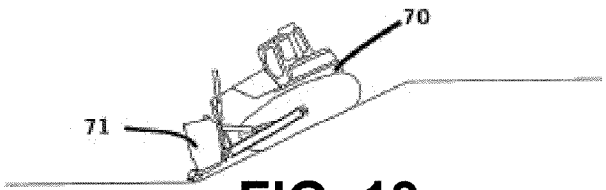
FIG. 13 shows the bulldozer and blade of FIG. 9 with the blade tilting upwardly prior to entering a second horizontal ground surface.
Figure 14:
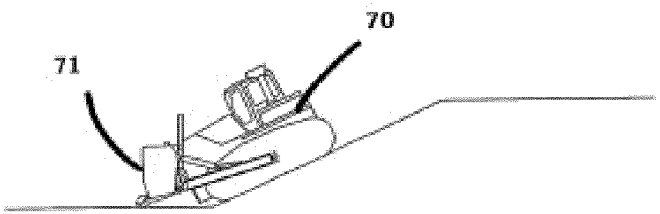
FIG. 14 shows the bulldozer and blade shown in FIG. 9 with the bulldozer about to enter the lower horizontal ground surface.

In FIG. 11 the bulldozer 70 moves forward and the blade moves downwardly first under operation of pistons 74 and 72 and arms 73. As a result the blade 71 has an initial forward pitch as the dozer starts to dig and once the dozer follows the blade into the inclined area as shown in FIG. 12, the blade is returned to its neutral position again by operation of pistons 72 to 74 and arms 73.

Figure 15:
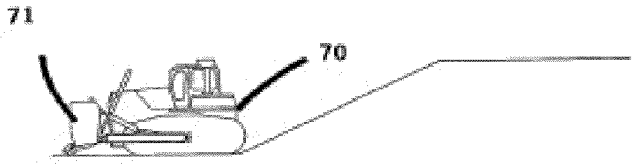
FIG. 15 shows the bulldozer and blade of FIG. 9 moving along a lower horizontal ground surface.

Once the dozer is following the incline downwardly the blade 71 is loaded with material and the blade is then required to pitch backwardly so that the dozer can start pushing the material to the dump site. Thus in FIGS. 13 and 14 it is shown how operation of pistons 72 and 74 results in an upward tilt of blade 71 as the dozer moves from the incline to the flat surface and then once on the flat surface or as the dozer completes movement to the flat surface, the blade is again tilted back to the neutral position as shown in FIG. 15.

Although the example given above relates to movement of the dozer from a level to a downwardly inclined slope and back to a level surface, the operations involved with regard to movement of piston arms and blade 71 are simply reversed if the dozer moves in the opposite direction. As a result it is clear that there are movements of the blade which are effectively repeated and can be stored in the data processor for automated operation depending upon the type of terrain on which the dozer is to work. Thus the onboard data processor or even a remote data processor which has information relayed to it from the bulldozer can be programmed to tilt the blade in accordance with the operation shown in FIGS. 9 to 11 to the neutral position shown in FIG. 12 and then again tilt the blade in the manner shown and described in relation to FIGS. 13 and 14 with the result that it again ends in the neutral position as shown in FIG. 15. For an upwardly inclining movement of the bulldozer the tilting movement of the blade is simply reversed.

It is to be understood that tilting of the blade is controlled by the tilting and lift pistons and the control arms of the bulldozer. Accordingly a data processor effectively through sensors located on each of these components can determine the orientation of the blade and can automatically control these components to tilt the blade as the bulldozer moves. Likewise sensors can be located on the blade.

Figure 16:
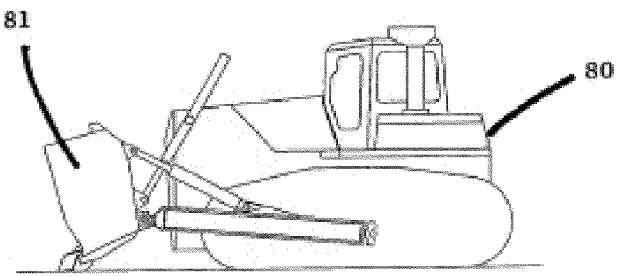
FIG. 16 shows a blade according to one embodiment of the invention attached to a bulldozer with the blade oriented downwardly to engage a horizontal ground surface.
Figure 17:
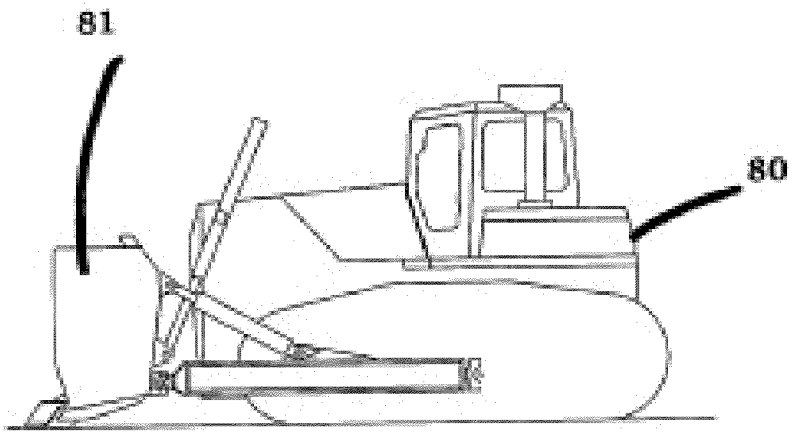
FIG. 17 shows the blade and bulldozer of FIG. 16 with the blade tilted upwardly after engaging the ground surface.
Figure 18:
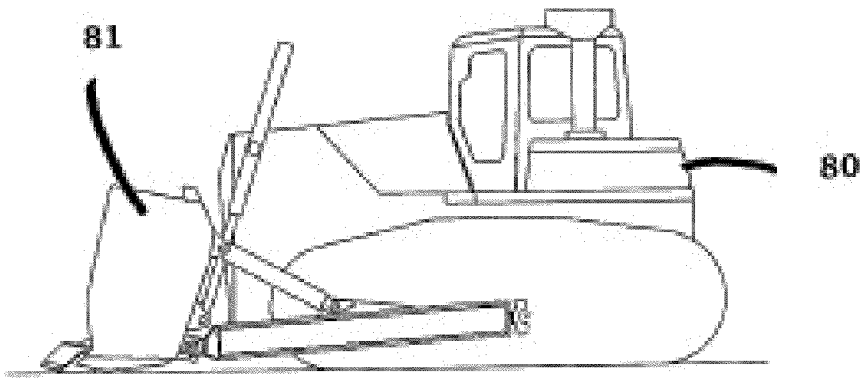
FIG. 18 shows the bulldozer and blade of FIGS. 16 and 17 with the blade tilted upwardly and rolled back after collecting material in the blade.

In accordance with another mode of operation of a dozer utilising the blade of the preferred embodiment of the invention, it is noted that if the blade 81 as shown in FIG. 16 is tilted forwardly to cut into a ground surface there is a tendency because of the design of the blade to cut deeper into the ground surface. This causes the blades cutting edges and/or corner tips to dip lower than the ground level and adjustments need to be made with the lift mechanism to keep the blade at the same height. Accordingly it is preferable that once the forwardmost cutting edges of the blade cut into the ground, there is a rollback operation involving tilting the blade upwardly as shown in FIG. 17 back to a neutral position. As shown in FIG. 18 a final slight tilting upwardly can be initiated to collect material on to the blade and enable it to be carried to a dumping location.

In accordance with one embodiment of the invention the data processor is programmed to operate the lifting and tilting pistons in conjunction with the supporting arms to initially tilt the blade 81 forward so that the forward most edge cuts into a ground surface and then to operate these components to tilt the blade 81 to a neutral position so the bottom edge of the front edge of the blade is able to travel in a horizontal orientation. Finally material collected within the confines of the blade 81 is able to be transferred to another location by a slight further tilting of the blade upwardly so that the forward most edge of the blade is not engaging with the ground surface.

In accordance with one embodiment of the invention a data processor on board the bulldozer or remote from the bulldozer is programmed to adjust the blade to keep the nominated cutting edges or corner tips at a constant height. The actual height selected will be dependent upon a number of factors such as the hardness of the ground surface, the size of the bucket, the size of the dozer, the angle of the ground surface etc.

It is considered that the blades outlined above should reduce the dependency of the steering clutches and brakes to keep a bulldozer moving straight when loading the blade. It is intended the operator will still have the ability to steer with the tilting action of the blade and it is expected that this ability will be greatly increased as the majority of the load will now be central. It is further expected that this will in fact make the job of controlling the blade when loading easier.

It is to be understood that, if any prior art publication is referred to herein, such reference does not constitute an admission that the publication forms a part of the common general knowledge in the art, in Australia or in any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A blade for an excavating apparatus comprising a substantially concave front face with a side wall on each side of the front face, said front face has a raised substantially concave centre section at a substantially central and lower position on the front face, said front face has a side gusset portion on each side of the centre section, side gusset portions slope from the centre section, said front face has a centre forward edge portion, a side forward edge portion on each side of the centre forward edge portion and an end forward edge portion on each distal side of the side forward edge portion;

wherein an angular position of the centre forward edge portion is discontinuous with the concave arc of the centre section and the concave arc of the centre section is discontinuous with the concave arc of a front face section above the centre section to form three adjacent discontinuous sections which cooperate with the side gusset portions to direct excavated material outwardly from the centre section towards the side walls.

2. The blade as claimed in claim 1 wherein each gusset portion comprises a curved plate section curved towards respective side walls.

3. The blade as claimed in claim 1 wherein each gusset portion comprises a generally triangular surface portion.

4. The blade as claimed in claim 1 wherein the centre section has substantially the same width as the centre forward edge portion.

5. The blade as claimed in claim 1 wherein each gusset portion extends at a slant forwardly to an outer mid section of the side forward edge.

6. A method of controlling a blade as claimed in claim 1 comprising moving the blade forward through material to collect material, pitching the blade backwards to collect and hold material in the blade, moving the blade to a dump position and tilting the blade forward to dump material at the dump position.

7. The blade as claimed in claim 1 wherein the width of the centre forward edge portion is less than the width between tracks of a vehicle or wheels of a vehicle to which the blade is attached.

8. The blade as claimed in claim 1, wherein the width of the centre forward edge portion is less than the width of the side forward edge portions.

9. The blade as claimed in claim 1 wherein the width of the end forward edge portions are less than the width of the side forward edge portions.

10. The blade as claimed in claim 1 wherein the width of the end forward edge portions is less than the width of the centre forward edge portion.

11. The blade as claimed in claim 1 wherein the side walls are substantially vertical and extend outwardly from the front face, said end forward edge portions are attached to the side walls and extend further than the side walls.

12. The blade as claimed in claim 1 wherein in a neutral position the end forward edge portions have bottom edges which are lower than a bottom edge of the centre forward edge.

13. The blade as claimed in claim 1 wherein in a neutral position the end forward edge portions are positioned behind the centre forward edge.

14. The blade as claimed in claim 1 wherein a degree of curvature of the centre section is less than a degree of curvature of the front face.

15. The blade as claimed in claim 1 wherein the centre forward edge portion is not aligned with a curvature of the concave centre section.

16. A system comprising the blade as claimed in claim 1 and a controller for controlling operation of the blade, the controller comprising a first module for controlling operation of one or more tilting pistons, a second module for controlling one or more lifting pistons and a third module for controlling one or more blade support arms, wherein based on data relating to the material which is to be engaged by the blade, the second module is operated to control the lifting piston to drop the blade, the first module is operated to control the tilting piston to tilt the blade downwardly and wherein when the centre forward edge portion of the blade has cut into a ground surface the first module is operated to control the one or more tilting pistons to tilt the blade upwardly while maintaining the lowermost edge of the centre forward edge portion below the ground surface.

17. The system as claimed in claim 16, wherein the third module is operated to maintain the blade in a substantially constant position relative to the ground surface.

18. The method claimed in claim 6 wherein the front face is contoured so that in use materials slides off it when a top edge of each of the side walls is parallel to the ground.

19. The method claimed in claim 6 wherein tilt pistons are controlled to tilt the blade forwardly to dislodge material collected by the blade.

20. The method claimed in claim 6 wherein the blade includes corner tips, said corner tips of the blade being lower than the centre forward edge portion when the blade is in a carry position.

21. The method as claimed in claim 6, wherein the centre forward edge portion is lower than end forward edges when the blade is tilted forward into a digging position.

22. The method as claimed in claim 6, wherein the side walls are forward of a back edge of the side forward edges.

23. The method as claimed in claim 6, wherein the centre forward edge portion is at the same level as the side forward edges when the blade is in the carry position.

24. A method of controlling a blade as claimed in claim 1, the method comprising moving the blade downwardly, forcing a lowermost edge of the blade below a ground surface and tilting the blade upwardly while the lowermost edge is below the ground surface.

* * * * *

UNITED STATES PATENT AND TRADEMARK OFFICE

CERTIFICATE OF CORRECTION

PATENT NO. : 8,291,624 B2
APPLICATION NO. : 12/439957
DATED : October 23, 2012
INVENTOR(S) : David John Hall It is certified that error appears in the above-identified patent and that said Letters Patent is hereby corrected as shown below:

On the title page, in item (56) add the following after the FOREIGN PATENT DOCUMENTS section:

OTHER PUBLICATIONS

International Preliminary Report on Patentability, International Application No. PCT/AU2007/001297, Issued on March 10, 2009

Written Opinion of International Searching Authority, International Application No. PCT/AU2007/001297, Mailed on November 9, 2007

Signed and Sealed this
Twenty-second Day of January, 2013

David J. Kappos

David J. Kappos
*Director of the United States Patent and Trademark Office*